US005443055A

United States Patent [19]

Schneider et al.

[11] Patent Number: 5,443,055

[45] Date of Patent: Aug. 22, 1995

[54] IGNITION SYSTEM FOR INTERNAL COMBUSTION ENGINES

[75] Inventors: Andreas Schneider, Sindelfingen; Reinhard Gantenbein, Sersheim, both of Germany

[73] Assignee: Robert Bosch GmbH, Stuttgart, Germany

[21] Appl. No.: 244,671

[22] PCT Filed: Nov. 13, 1992

[86] PCT No.: PCT/DE92/00949

§ 371 Date: Jun. 7, 1994

§ 102(e) Date: Jun. 7, 1994

[87] PCT Pub. No.: WO/9312341

PCT Pub. Date: Jun. 24, 1993

[30] Foreign Application Priority Data

Dec. 7, 1991 [DE] Germany ..... 41 40 416.5

[51] Int. Cl.[6] ..... F02P 3/06

[52] U.S. Cl. ..... 123/602

[58] Field of Search ..... 123/602, 603, 198 F, 123/335, 198 DC, 630, 632

[56] References Cited

U.S. PATENT DOCUMENTS

| | | | |
|---|---|---|---|
| 4,624,234 | 11/1986 | Koketsu et al. | 123/602 |
| 4,651,705 | 3/1987 | Kinoshita | 123/603 |
| 4,672,941 | 6/1987 | Yamagata | 123/602 |
| 4,697,570 | 10/1987 | Ionescu et al. | 123/602 |
| 4,757,797 | 7/1988 | Bengtsson | 123/602 |
| 5,024,204 | 6/1991 | Dykstra | 123/602 |
| 5,050,553 | 9/1991 | Erhard | 123/602 |

FOREIGN PATENT DOCUMENTS

| | | |
|---|---|---|
| 3200856A1 | 12/1982 | Germany . |
| 3917808A1 | 12/1989 | Germany . |
| 55-134758 | 12/1980 | Japan . |
| 60-062666 | 4/1985 | Japan . |

*Primary Examiner*—Raymond A. Nelli
*Attorney, Agent, or Firm*—Kenyon & Kenyon

[57] ABSTRACT

An ignition system for internal combustion engines with a control unit for triggering at least one ignition final stage and means for suppressing a switch-on spark. A first embodiment of an ignition system in accordance with the present invention includes a voltage-controlled switch coupled to each output of the control unit for coupling the respective output to ground until the supply voltage ramps up to a value required for the operation of the control unit. A second embodiment of an ignition system in accordance with the present invention includes a voltage-controlled switch which is coupled to all outputs of the control unit, and which switches all outputs to ground until the supply voltage ramps up to a value required for the operation of the control unit.

8 Claims, 1 Drawing Sheet

IGNITION SYSTEM FOR INTERNAL COMBUSTION ENGINES

FIELD OF THE INVENTION

The present invention relates to ignition systems for internal combustion engines. More specifically, the present invention relates to an ignition system with means for suppressing a transient switch-on condition.

BACKGROUND OF THE INVENTION

Ignition systems, with suppression of a faulty ignition signal after the ignition system has been put into operation, are already known from the German Published Patent Application No. 39 17 808 A1. In this known ignition system, the ignition signal supplied by the control unit is combined with the output signal of a delay circuit which, after the current supply has been switched on, delays the crankshaft angle signal, for example, for a predetermined time so that the trigger signal for the ignition end stage is likewise delayed. The delay takes place by means of an RC element, for example. The realization of the suppression of a switch-on spark is relatively complicated in this case due to the use of a timing element. Finally, no possibility is provided for ensuring that the supply voltage is sufficient for the control unit at the end of the delay period and that, therefore, defined conditions are present at the individual control outputs.

SUMMARY OF THE INVENTION

The arrangement according to the present invention, in contrast to the prior art, has the advantage that immediately after the ignition system has been put into operation, by actuating the ignition switch, for example, each control output of the control unit is immediately drawn to an active low level. It may be regarded as a further advantage that the low level at the output is retained until such time as the supply voltage necessary for the control unit has been built up.

Advantageous further developments and improvements to the ignition system given in the main claim are possible by means of the measures listed in the subclaims. It is particularly advantageous for the switching of the control unit output to earth to take place by means of a voltage-controlled switch so that no additional control current is necessary for this switch. It may be regarded as a further advantage that either each output of the control unit is individually switched to earth by means of a voltage-controlled switch, for example a MOSFET, in order to trigger an ignition end stage or that the outputs of the control unit are respectively lead to a collecting line and are, in this way, switched to earth by means of a MOSFET located in the collecting line. It should finally be mentioned as an advantage that the triggering of the individual MOSFETs takes place as a function of the supply voltage. By this means, for example, the GATE can be lead to the DRAIN input of a further MOSFET connected between the ignition switch outgoing circuit and earth, this MOSFET being controlled as a function of the supply voltage.

DETAILED DESCRIPTION

Figure 1:
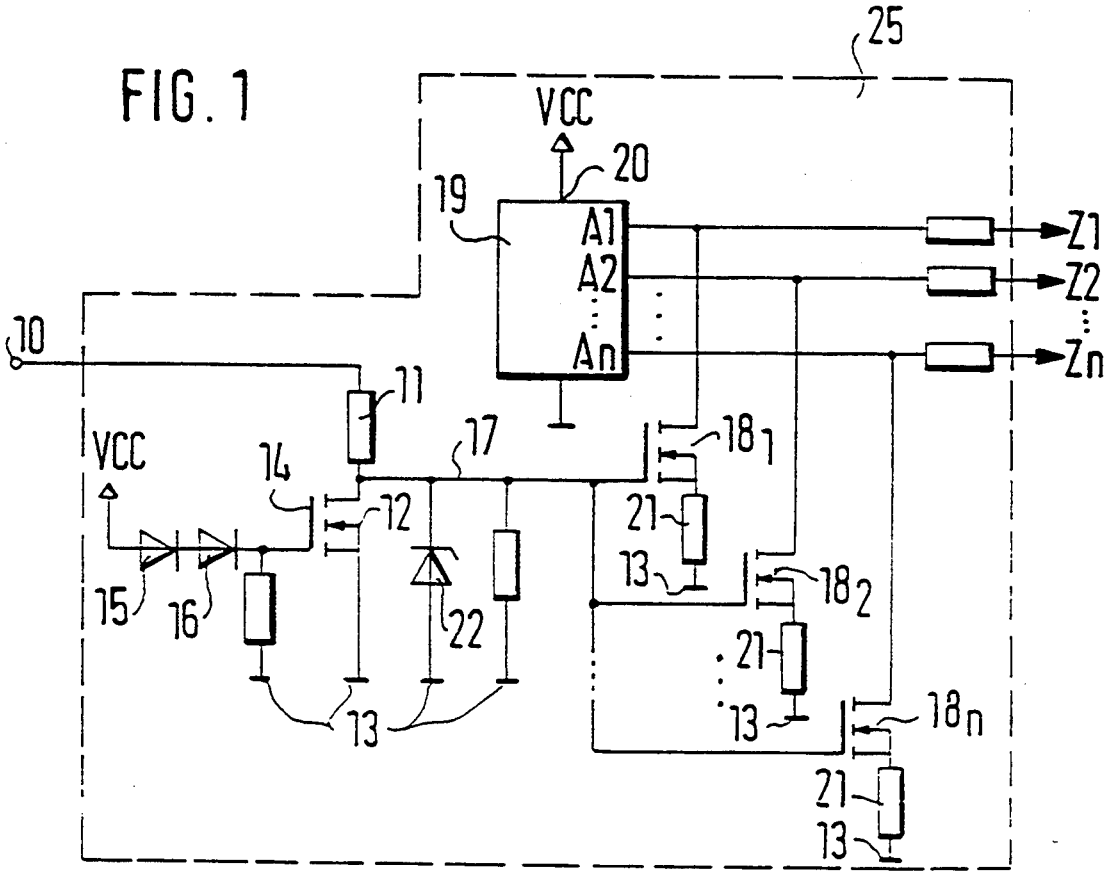
FIG. 1 shows a first embodiment of an ignition system in accordance with the present invention.

In FIG. 1, a terminal 10, for example the ignition switch outgoing circuit of an internal combustion engine, is connected via a resistor 11 to a DRAIN input of a MOSFET 12, which is switched to earth 13 via a SOURCE terminal of the MOSFET. A supply voltage VCC is lead to the control input GATE 14 of the MOSFET 12, two diodes 15 and 16 being connected between the supply voltage VCC and the GATE. A connection 17 leads from the DRAIN input of the MOSFET 12 to GATE connections of further MOSFETs $\mathbf{18}_1$ to $\mathbf{18}_n$, where n corresponds to the number of ignition final stages to be activated. Furthermore, a Zener diode 22 is connected to earth 13 in parallel with the MOSFET 12 in order to intercept voltage peaks. The DRAINs of the MOSFETs $\mathbf{18}_1$ to $\mathbf{18}_n$ are respectively connected to the outputs A1 to An of an integrated driver module 19. The driver module 19 is connected at its terminal 20 to the supply voltage VCC. The driver module 19 is, furthermore, connected by means of its outputs A1 to An at Z1 to Zn to the ignition final stages (not shown), on the one hand, it being of no importance whether rotating or stationary high voltage distribution is involved, and they have to be connected via the MOSFETs 18 to $\mathbf{18}_n$ to earth 13, on the otherhand.

The circuit just described has the following mode of operation. When the ignition switch 10 is switched on, a high voltage level is applied via the resistor 11 at each GATE of the MOSFETs $\mathbf{18}_1$ to $\mathbf{18}_n$, so that the latter are in the conducting condition, i.e. all the outputs A1 to An are switched to earth 13, so that the ignition final stages are blocked and no current flows in any of the ignition coils connected to them. The current at the outputs A1 to An is then respectively limited by a resistor 21 located in the main current circuit of each of the MOSFETs $\mathbf{18}_1$ to $\mathbf{18}_n$. After the ignition has been switched on, the supply voltage VCC is not immediately available due to delay or switching times and capacitive re-charging. After the necessary supply voltage VCC has been attained, the MOSFET 12 is tripped by force by means of the supply voltage VCC which is in connection with the GATE 14, the value with which the GATE 14 is in connection with VCC being fixed by the dimensions of the diodes 15 and 16. At the moment when the MOSFET 12 is tripped by force, the control voltage of the MOSFETs $\mathbf{18}_1$ to $\mathbf{18}_n$ is drawn towards earth potential, i.e. towards zero, so that the MOSFETs $\mathbf{18}_1$ to $\mathbf{18}_n$ are blocked and the triggering of the ignition final stages Z1 to Zn can take place via the outputs A1 to An. This ensures that after the ignition switch 10 has been actuated and while the supply voltage VCC is running up, no undesired current flows in the ignition coils due to undefined conditions at the outputs A1 to An. Otherwise, when the supply voltage VCC is attained, it would be possible for an undesired ignition spark to occur due to the LOW signal output if, for example, an output A of the control unit 19 had previously emitted an undefined signal. The circuit arrangement just described can have already been realized in an ignition control unit 25 so that the outputs of this ignition control unit 25 should then be designated by Z1 to Zn.

Figure 2:
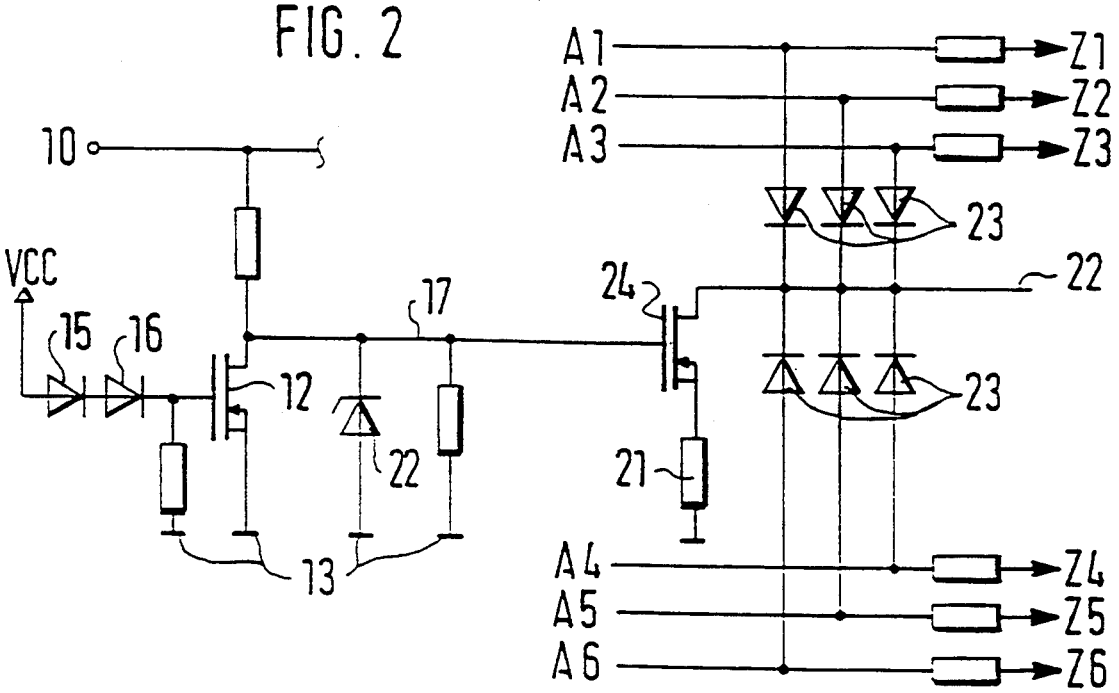
FIG. 2 shows a second embodiment of an ignition system in accordance with the present invention.

FIG. 2 likewise shows a switch-on spark suppression circuit which is similarly constructed to the circuit in FIG. 1. For this reason, the same reference symbols are used for the same components. The outputs A1 to A6 of the driver module (not shown) here trigger the ignition final stages via Z1 to Z6. A tapping is lead from each control output A1 to A6 to a collecting line 22, a diode 23 being respectively connected in the conducting direction from the tapping at the output of the control unit to the collecting line 22. This collecting line 22 is connected to the DRAIN connection of a MOSFET 24 connected to earth via the resistor 21, so that when the supply voltage VCC has not built up completely, all the outputs A1 to A6 are connected to earth 13. This circuit is therefore reduced relative to the circuit of FIG. 1, so that a MOSFET does not have to be provided for each output of the control unit to trigger an ignition final stage, but the outputs can, rather, be connected to earth via a collecting line and a single MOSFET.

The circuit described here has been constructed using an n-channel MOSFET, but other types of switches are quite conceivable.

The final stage locking at the terminals Z1 to Zn represented in FIGS. 1 and 2 can either take place externally at the individual outputs of the control unit or can have already been realized internally in the ignition control unit 25, which then has the outputs Z1 to Zn. Realization in the ignition control unit 25 has the advantage that no additional structural elements would be necessary.

Analogously to the exemplified embodiment just described, it is also possible to block the triggering of the ignition final stages by means of the ignition control unit by arranging a switch in the connection from the output of the control unit to the ignition final stage, this switch being open until the necessary supply voltage VCC is attained and closing when VCC is attained. A voltage-controlled switch—likewise, for example, a MOSFET of an enhancement type—can then be employed.

What is claimed is:

1. An ignition system for internal combustion engines, the ignition system comprising:

an ignition control unit with at least one output for triggering at least one ignition final stage;

at least one voltage-controlled switch for selectively inhibiting the at least one output of the ignition control unit by coupling the at least one output to a ground; and a switch control sub-circuit for controlling the at least one voltage-controlled switch to inhibit the at least one output of the ignition control unit as a function of a supply voltage supplied to the control unit.

2. The ignition system according to claim 1, wherein:

the switch control sub-circuit includes a further voltage-controlled switch with a main current branch coupled between an ignition switch outgoing circuit and ground and with a control input coupled to the supply voltage; and a control input of the at least one voltage-controlled switch is coupled to the main current branch of the further voltage-controlled switch.

3. The ignition system according to claim 2, wherein the further voltage-controlled switch is coupled to the ignition switch outgoing circuit via a resistor and is tripped by force when the supply voltage is attained, so that the control input of the at least one voltage-controlled switch is coupled to ground, thereby blocking the at least one voltage-controlled switch.

4. The ignition system according to claim 1, wherein each of the at least one output of the control unit is coupled to a respective one of the at least one voltage-controlled switch.

5. The ignition system according to claim 1, wherein a plurality of the outputs of the control unit are coupled to a single voltage-controlled switch.

6. The ignition system according to claim 1, wherein a resistor is connected in a main current branch of each of the at least one voltage-controlled switch.

7. The ignition system according to claim 2, wherein the voltage-controlled switches are MOSFETs, preferably of the enhancement type.

8. The ignition system according to claim 1, wherein the ignition control unit, the at least one voltage-controlled switch, and the switch control sub-circuit are integrated into an integrated control unit.

* * * * *